United States Patent [19]

Kamp et al.

[11] Patent Number: 4,901,932

[45] Date of Patent: Feb. 20, 1990

[54] TRAVERSE WINDING APPARATUS FOR A MACHINE PRODUCING CROSS-WOUND BOBBINS

[75] Inventors: Heinz Kamp, Wegberg; Rolf Becker, Mönchengladbach, both of Fed. Rep. of Germany

[73] Assignee: W. Schlafhorst & Co., Mönchengladbach, Fed. Rep. of Germany

[21] Appl. No.: 240,945

[22] Filed: Sep. 6, 1988

[30] Foreign Application Priority Data

Sep. 3, 1987 [DE] Fed. Rep. of Germany ..... 3729472

[51] Int. Cl.[4] ..... B65H 54/28; B65H 57/28

[52] U.S. Cl. ..... 242/43 A; 242/158 B

[58] Field of Search ..... 242/43 R, 43 A, 158 B

[56] References Cited

U.S. PATENT DOCUMENTS

| | | | |
|---|---|---|---|
| 1,239,669 | 9/1917 | Colman | 242/158 B |
| 3,333,782 | 8/1967 | Beckwith, Jr. | 242/43 A |
| 4,674,695 | 6/1987 | Kamp et al. | 242/43 A |
| 4,807,822 | 2/1989 | Kamp et al. | 242/43 A |

FOREIGN PATENT DOCUMENTS

| | | |
|---|---|---|
| 1921859 | 11/1969 | Fed. Rep. of Germany . |
| 3505188 | 8/1986 | Fed. Rep. of Germany . |
| 3543388 | 6/1987 | Fed. Rep. of Germany . |
| 972440 | 1/1951 | France . |

*Primary Examiner*—John M. Jillions
*Assistant Examiner*—Eric P. Dunlap
*Attorney, Agent, or Firm*—Herbert L. Lerner; Laurence A. Greenberg

[57] ABSTRACT

A machine producing cross-wound bobbins or cheeses has a drum winding a yarn travelling in a given yarn travel direction on a cheese over a given traverse winding width with reversal points. A traverse winding apparatus includes a traction mechanism transmission having an endless traction mechanism. The traction mechanism is guided over rollers defining first and second traction mechanism segments movable in opposite directions at the same speed. The traction mechanism includes yarn entrainers spaced apart by at least substantially twice the given traverse winding width. First, second and at least one further yarn guide are in alternation with the traction mechanism segments as seen in the given yarn travel direction for supporting the yarn during traverse winding and for transferring the yarn between the yarn entrainers at the reversal points. Each of the yarn guides has a concave yarn guide contour with decreasing depth as seen in the given yarn travel direction to be contacted by the travelling yarn.

9 Claims, 4 Drawing Sheets

TRAVERSE WINDING APPARATUS FOR A MACHINE PRODUCING CROSS-WOUND BOBBINS

BACKGROUND OF THE INVENTION

Field of the Invention

The invention relates to a traverse winding or thread traversing apparatus for a machine producing cross-wound bobbins or cheeses, including a traction mechanism transmission or gearing having an endless traction mechanism guided over rollers defining a first traction mechanism segment movable in a traverse winding direction and a second traction mechanism segment movable opposite to the first traction mechanism segment at the same speed, the traction mechanism including yarn entrainers spaced apart by at least approximately twice the traverse winding width, and yarn guides laterally of the traction mechanism supporting the yarn upon traverse winding and transferring the yarn at reversal points of the traverse winding from the yarn entrainer of one traction mechanism segment to the yarn entrainer of the other traction mechanism segment, each yarn guide having a concave yarn guide contour contacted by the travelling yarn, the contour of at least one yarn guide lifting the travelling yarn over the upper end of the yarn entrainer at the reversal points of the traverse winding, so that the yarn sliding along the yarn guide contour can be entrained by the oppositely moving yarn entrainer.

The traverse winding apparatus is provided for maintaining the traverse yarn motion as uniform as possible over the entire traverse winding range, in order to move the yarn as quickly as possible into the opposite direction at the points of reversal of the traverse winding, and therefore to avoid defects in yarn laying, running or winding as much as possible. A traverse winding apparatus of this generic type is known, for example, from German Published, Non-Prosecuted application DE-OS 35 05 188, corresponding to U.S. Pat. No. 4,674,695.

However, the possible traverse winding speed attainable without malfunction in prior art traverse winding apparatuses is limited.

SUMMARY OF THE INVENTION

It is accordingly an object of the invention to provide a traverse winding or thread traversing apparatus for a machine producing cross-wound bobbins or cheeses, which overcomes the hereinafore-mentioned disadvantages of the heretofore-known devices of this general type and which attains the highest possible malfunction-free traverse winding speed and a high traverse winding frequency, in order to enable production of cheeses with the highest possible winding speed.

With the foregoing and other objects in view there is provided, in accordance with the invention, a traverse winding apparatus for a machine producing cross-wound bobbins or cheeses including a drum or roller winding a yarn travelling in a given yarn travel direction on a cheese over a given traverse winding width with reversal points along a yarn running line, comprising a traction mechanism transmission having an endless traction mechanism, rollers over which the traction mechanism is guided defining a first traction mechanism segment movable in a given traverse winding direction and a second traction mechanism segment movable in a direction opposite to the given direction at the same speed; the traction mechanism including yarn entrainers having upper ends and being spaced apart by at least substantially twice the given traverse winding width first, second and at least one further yarn guide means disposed laterally of the traction mechanism for supporting the yarn during traverse winding and for transferring the yarn at the reversal points from the yarn entrainer of one of the traction mechanism segments to the yarn entrainer of the other of the traction mechanism segments; each of the yarn guide means having a concave yarn guide contour contacted by the travelling yarn, at least one of the contours lifting the travelling yarn over the upper end of one of the yarn entrainers at the reversal points permitting the yarn sliding along the at least one contour to be entrained by the entrainer moving in the opposite direction; the first yarn guide means being disposed upstream of the first traction mechanism segment as seen in the given yarn travel direction, the second yarn guide means being disposed between the first and the second traction mechanism segments, and the at least one further yarn guide means being disposed downstream of the second traction mechanism segment; the contour of the first yarn guide means being deeper than the contour of the second yarn guide means, and the contour of the second yarn guide means being deeper than the contour of the at least one further yarn guide means, the travelling yarn sliding along and looping part way around the contour of the first yarn guide means and the contours being shaped and aligned relative to one another and to the yarn running line causing the yarn to travel from the contour of the first yarn guide means toward the yarn running line with loop-free contact with the contour of at least the second yarn guide means over a considerable portion, especially the middle portion, of the traverse winding width.

While the yarn guide means located upstream or to the rear (that is, the first yarn guide means) as seen in the viewing or yarn travel direction, not only has the function of guiding the yarn but also of acting as a brake for yarn looping, the other yarn guide means primarily are assigned the function of yarn guidance. They are intended to perform a braking function only to the extent that by touching the yarn they contribute to the calming thereof and to damping vibration.

A state of tension is established in the travelling yarn between the yarn guide contour of the yarn guide means located to the rear as seen in the yarn travel direction and the yarn laying or running line, that is not substantially changed disadvantageously by the other yarn guide means.

The results of the structure according to the invention is a traverse winding security which enables quicker traverse winding, or in other words a higher winding speed.

In accordance with another feature of the invention, one of the reversal points at each of the contours are in one line of sight and the other of the reversal points at each of the contours are in another line of sight, beginning at the next successive end of the yarn running line.

The lines of sight located at the reversal points of the traverse winding converge toward the cheese, or in other words toward the yarn laying or running line of the drum or roller that places the yarn against the cheese. The yarn laying or running line, or in words the bobbin width, is shorter than the traverse winding width in the vicinity of the traverse winding apparatus.

The difference in length is determined by the yarn tension, the distance of the traverse winding apparatus from the yarn running or laying line, the relative location of the cheese with respect to the yarn running or laying line, and the shape and configuration of the yarn guide means and the yarn entrainers, among other factors.

In accordance with a concomitant feature of the invention, the traction mechanism is an endless flat belt having a narrow edge on which the yarn entrainers are disposed; the first traction mechanism segment being disposed in the vicinity of and parallel to the yarn running line, the second traction mechanism segment being closely adjacent the first traction mechanism segment; the yarn guide means being formed of plate-like material, and both of the traction mechanism segments and the yarn guide means are upright or are inclined by a maximum of approximately 15° toward a side of the machine at which the yarn enters.

A configuration of this kind is advantageous particularly if the cross-wound bobbin or cheese rests on the roller or drum and is driven by it, which is typically true. The traverse winding apparatus is located upstream of the front of the roller or drum driving the cheese, so that there is no difficulty in mounting, removing or dismantling the traverse winding apparatus into its components.

Other features which are considered as characteristic for the invention are set forth in the appended claims.

Although the invention is illustrated and described herein as constructed in a traverse winding or thread traversing apparatus for a machine producing cross-wound bobbins or cheeses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
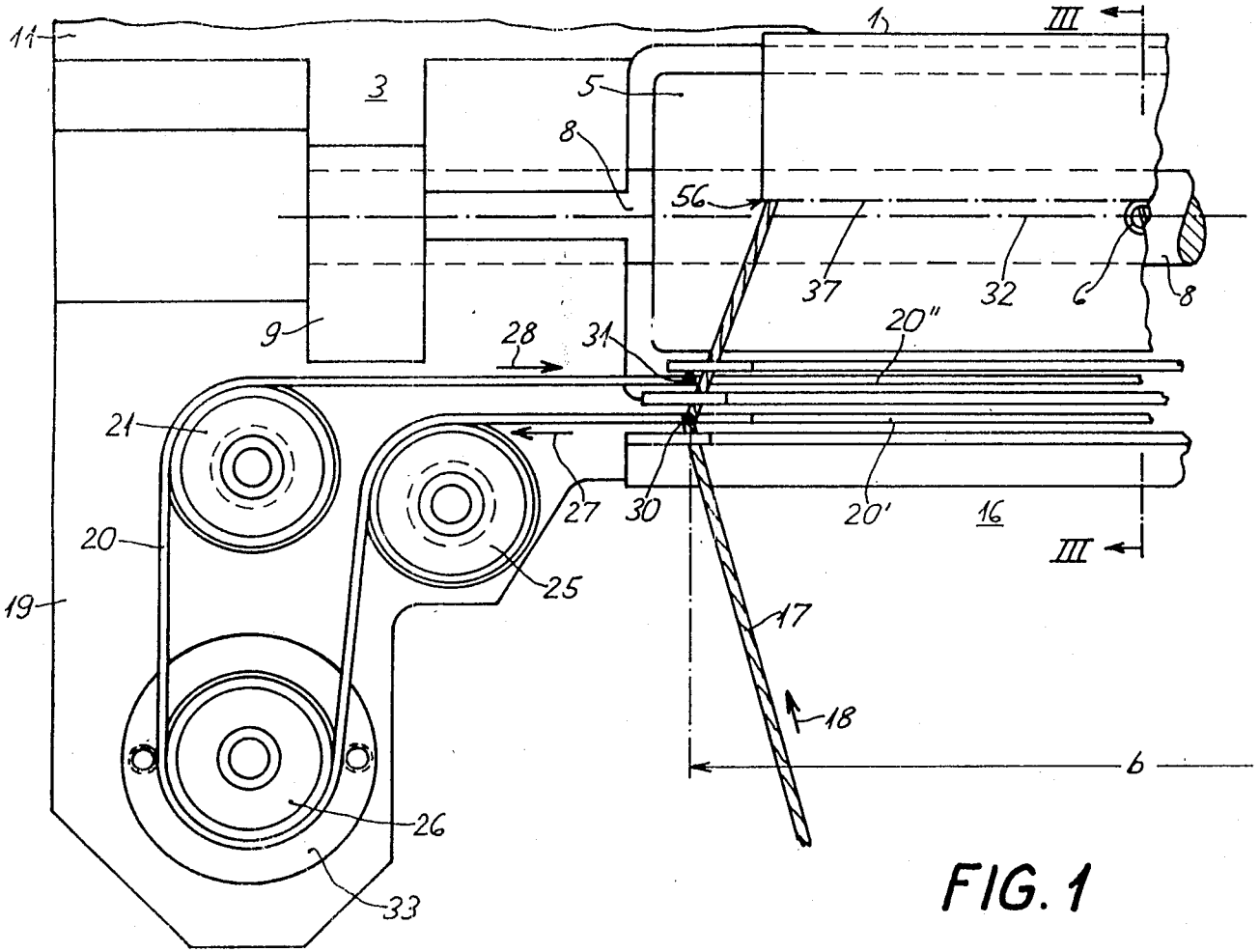
FIGS. 1 and 2 are fragmentary, diagrammatic, plan views of right and left portions of a traverse winding apparatus.
Figure 2:
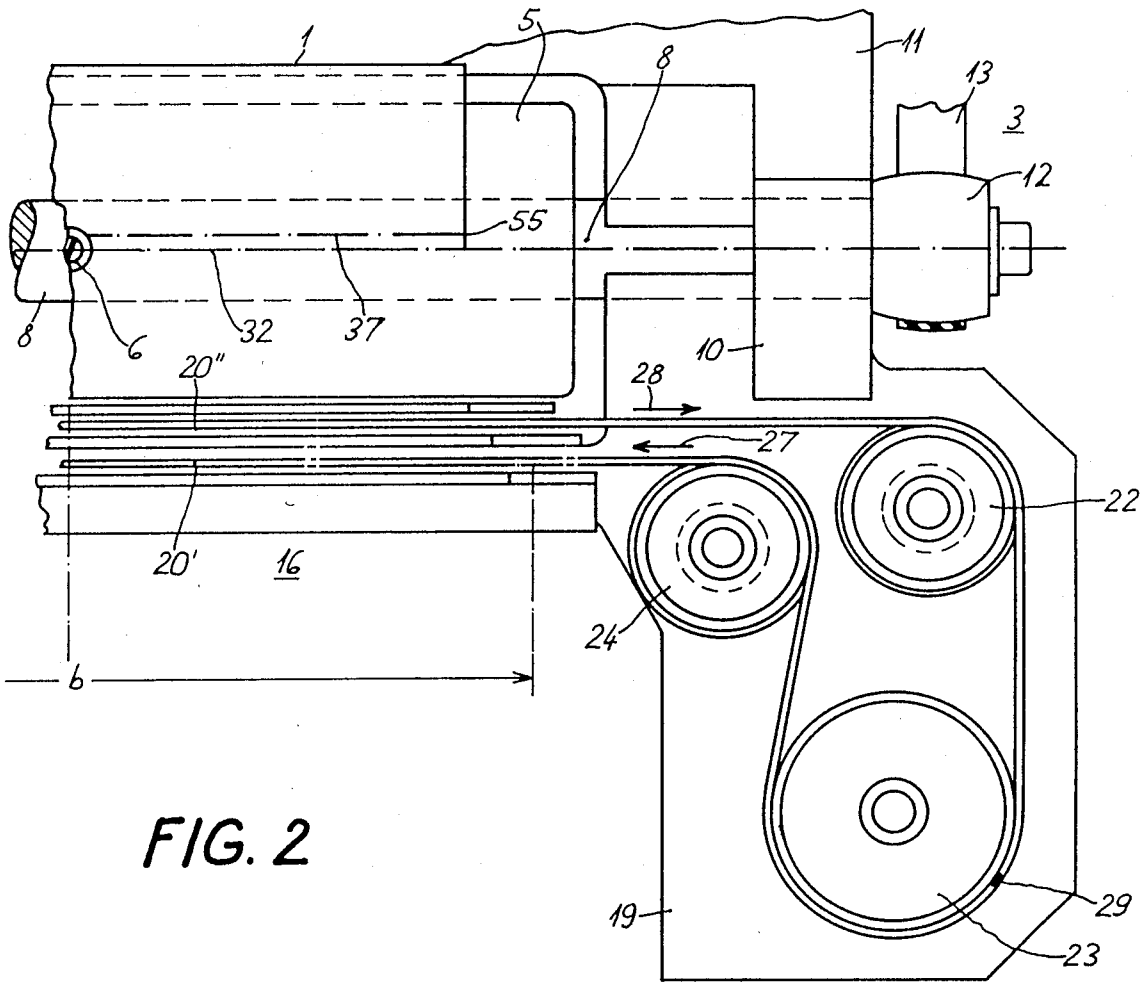
Figure 3:
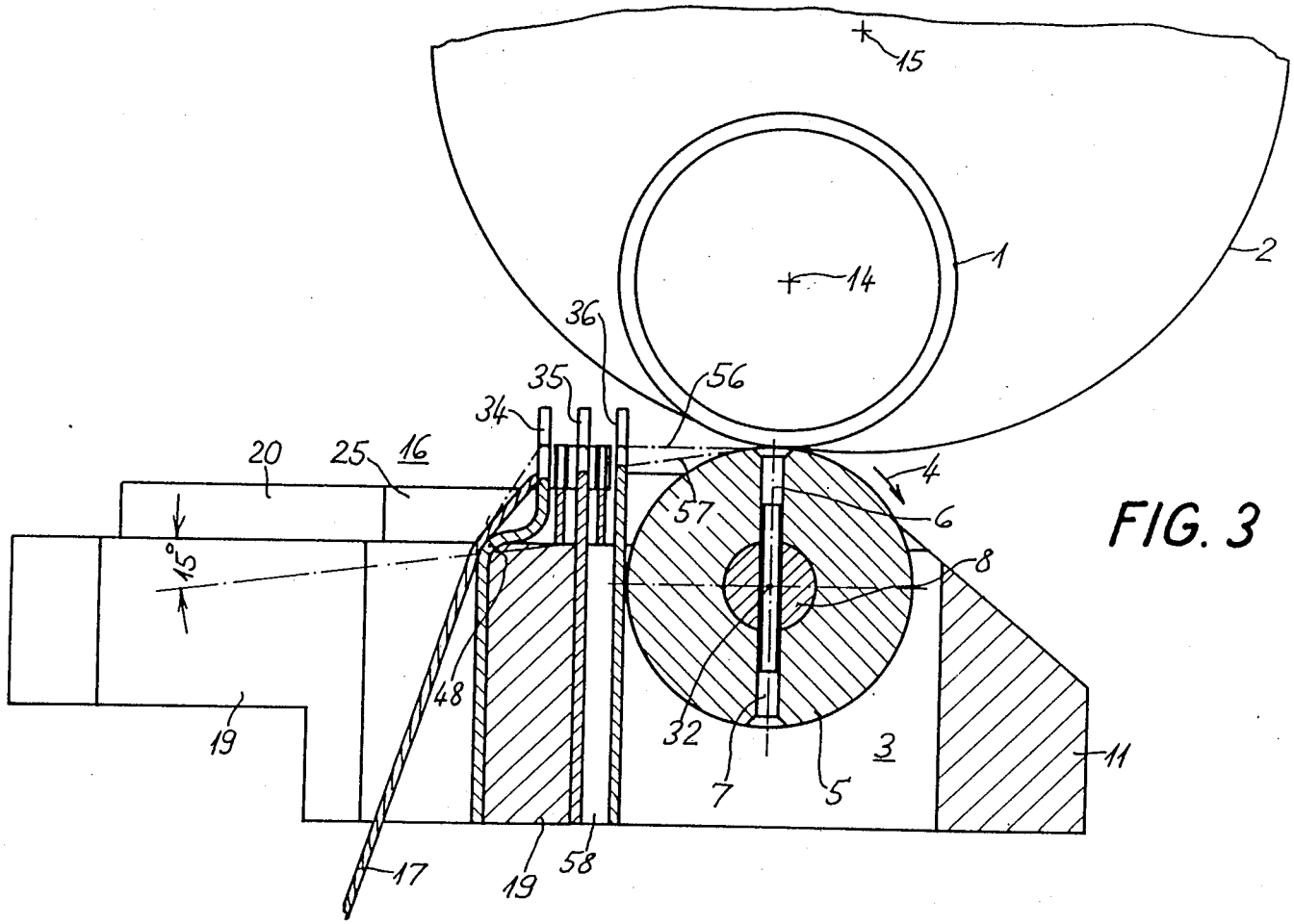
FIG. 3 is a fragmentary, sectional view taken along the line III—III of FIG. 1, in the direction of the arrows.

Referring now to the figures of the drawings in detail and first, particularly, to FIGS. 1–3 thereof, there is seen a machine 3 for producing cross-wound bobbins or cheeses 1 and 2, which includes only those parts important to an understanding of the invention. The machine 3 includes a drum 5 rotatable in the direction of a curved arrow 4 seen in FIG. 3. The drum 5 is connected to a winding shaft 8 by screws 6, 7.

The winding shaft 8 is supported in bearing blocks 9, 10. The bearing blocks 9, 10 are connected to a machine frame 11 of the machine 3. The winding shaft 8 has a wharve 12 on the right-hand end thereof and a drive belt 13 loops around the wharve. The drive belt 13 drives the wharve 12 and it also drives the drum 5 through the wharve and the shaft 8.

The cheese 1 may be held and supported in a non-illustrated pivotable creel, for example, in such a way that it presses against the drum 5 from above with a given pressing force and can be driven by the drum 5 by friction. In FIG. 3, the cheese 1 is shown during a phase in the formation thereof. The axis of rotation of the cheese 1 is shown at reference numeral 14. The cheese 2 in FIG. 3 is the cheese that later grows to a substantially greater diameter. The cheese 2 rotates about the axis of rotation 15 thereof. Due to the increase in size of the cheese, the axis of rotation shifts, while the non-illustrated creel pivots upward.

A traverse winding or thread traversing apparatus, which is identified generally by reference numeral 16, is located with the essential element thereof on the front of the machine 3, or in other words on the entry side for yarn 17 that is to be traverse-wound and later forms the cheese 1 or 2. The yarn 17 travels in the direction of an arrow 18.

The traverse winding apparatus 16 has an elongated bracket 19, which is connected at both ends thereof to the machine frame 11.

The actual traverse winding apparatus 16 is formed of a traction mechanism gear, transmission, linkage or power train having an endless traction mechanism 20 constructed as a flat belt. The flat belt 20 is guided over rollers 21–26 in such a way that it forms a first traction mechanism segment or run 20' which is movable in a traverse winding direction 27, and a second traction mechanism segment or run 20'' which is movable in a traverse winding direction 28, opposite the direction of travel of the first traction mechanism segment 20', but at the same speed. The traction mechanism 20 has yarn entrainers or drivers 29, 30 and 31, disposed at twice the spacing of the traverse winding width b. The yarn entrainers divide the traction mechanism into three sections of equal length, each being twice as long as the traverse winding width b. The yarn entrainers 29, 30, 31 are disposed on the upper narrow edge of the traction mechanism 20. The traction mechanism segments 20' and 20'' extend parallel to the longitudinal axis 32 of the winding shaft 8. They travel close to one another and upright, between yarn guide means that are also upright. The roller 26 is driven by an electric motor 33, of which only a securing flange is visible in FIG. 1. The electric motor 33 is connected to the bracket 19. The other rollers 21–25 are loose rollers, which are rotatably supported on the bracket 19.

Figure 4:
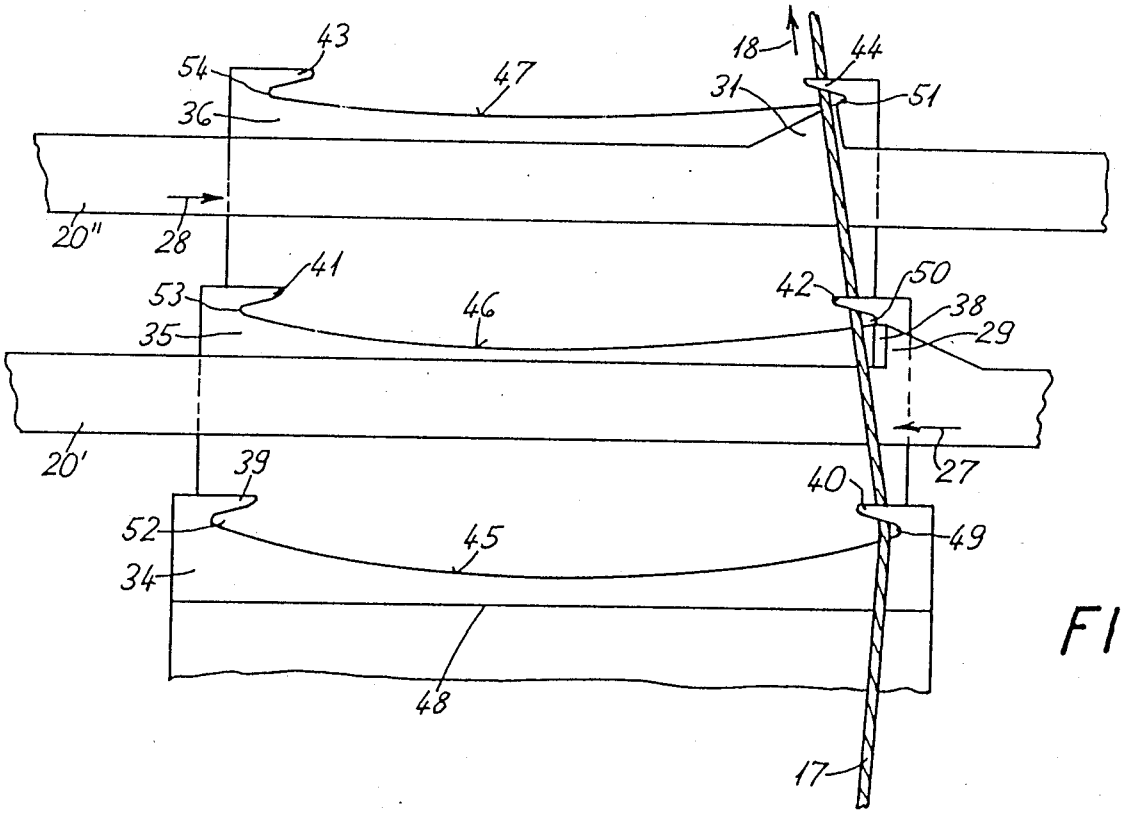
FIG. 4 is a stacked, disassembled, front view showing the configuration of yarn guide means.

FIG. 4 shows concave contours of three yarn guide means 34, 35 and 36. The first yarn guide means 34, which is located to the rear as seen in the yarn travel direction 18, is disposed in front of the first or front traction mechanism segment 20'. The second yarn guide means 35 is disposed between the first or front traction mechanism segment 20' and the second or rear traction mechanism segment 20''. The third yarn guide means 36 is disposed behind the second or rear traction mechanism segment 20''.

FIG. 4 shows that the front yarn guide means 34 has a more severely concave contour or greater curvature than the second or middle yarn guide means 35. The second or middle yarn guide means 35 in turn has a more severely concave contour than the third or rear yarn guide means 36.

The yarn 17 travels toward a yarn running, laying or winding line 37, which is represented as a line of contact between the drum 5 and the cheese 1.

FIG. 4 also illustrates that the yarn entrainers have a triangular profile, as is shown for the yarn entrainers 29 and 31, for instance. In each case the steep shoulder of the yarn entrainers is reinforced with a metal sleeve 38.

FIG. 4 also shows that the yarn guide means have protrusions at the reversal points of the traverse winding, which point against or counter to the traverse winding region. For instance, the yarn guide means 34 have protrusions 39 and 40: the yarn guide means 35 have protrusions 41 and 42; and the yarn guide means 36 have protrusions 43 and 44. The concave guide contours of the yarn guide means 34, 35, 36 are shown at reference numerals 45, 46, and 47, respectively.

The yarn guide means 34, 35 and 36 are made of plate-like material. While the yarn guide means 35 and 36 are flat, a yarn guide bead 48 is formed in the yarn guide means 34 by bevelling. The travelling yarn 17 rests on the yarn guide bead 48 and is thereby stabilized or calmed. It then loops part way around the guide contour 45 of the yarn guide means 34, contacts the guide contours 46 and 47 of the yarn guide means 35 and 36 without looping around them, and then reaches the yarn running, laying or winding line 37.

The yarn guide means 34, 35, 36 are constructed and disposed in such a way that the yarn guide contours 45, 46, 47 thereof at respective reversal points 49, 50, 51 in one direction or 52, 53, 54 in the other direction of traverse winding are each in one straight line of sight, which begins at the next successive end 55 or 56 of the yarn running, laying or winding line 37. At the reversal points of the traverse winding, the associated yarn guide contour merges with the respective protrusion, so that the travelling yarn cannot exceed the particular traverse winding width b, which is longest at the yarn guide means 34 and shortest at the yarn guide means 36.

FIG. 1 shows that the yarn entrainer 30 has already given up the yarn 17, while the yarn entrainer 31 arriving in the opposite traverse winding direction 28 has not yet grasped the yarn. Grasping of the travelling yarn 17 by the yarn entrainer 31 takes place only slightly later, when the yarn which slides downward along the yarn guide contours because of the winding traction, is overtaken by the yarn entrainer 31.

While FIG. 1 shows the yarn 17 at the left-hand reversal point of the traverse winding, the yarn 17 in FIG. 4 is shown at the right-hand reversal point of the traverse winding.

FIG. 3 indicates that the line of sight 56 extending through the respective reversal points 49, 50, 51 and 52, 53, 54 of the traverse winding extends approximately horizontally. The line of sight 57 extending through the middle of the traverse winding range over the guide contours 45, 46, 47 is inclined relative to the yarn travel direction by approximately 15°. This assures secure driving of the yarn by one of the three yarn entrainers even if the yarn should begin to vibrate. The upper edge of the traction mechanism 20 does not touch the yarn 17 in this process. FIG. 3 also indicates that the top of the bracket 19 can extend out of the horizontal by 15° relative to the yarn travel direction. In this way, the entire traverse winding apparatus 16 would also be given a corresponding inclination, and furthermore this would mean that the entire system of yarn guide means secured to the bracket 19, either directly or through spacers 58, would be inclined by 15° relative to the yarn travel direction.

We claim:

1. In a machine producing cross-wound bobbins or cheeses including a drum winding a yarn travelling in a given yarn travel direction on a cheese over a given traverse winding width with reverse points along a yarn running line, a traverse winding apparatus comprising:

a traction mechanism transmission having an endless traction mechanism, rollers over which said traction mechanism is guided defining a first traction mechanism segment movable in a given traverse winding direction and a second traction mechanism segment movable in a direction opposite to said given direction at the same speed;

said traction mechanism including yarn entrainers having upper ends and being spaced apart by at least substantially twice the given traverse winding width;

first, second and at least one further yarn guide means disposed laterally of said traction mechanism for supporting the yarn during traverse winding and for transferring the yarn at the reversal points from said yarn entrainer of one of said traction mechanism segments to said yarn entrainer of the other of said traction mechanism segments;

each of said yarn guide means having a concavely curved yarn guide contour contacted by the travelling yarn, at least one of said contours lifting the travelling yarn over said upper end of one of said yarn entrainers at the reversal points permitting the yarn sliding along said at least one contour to be entrained by said entrainer moving in the opposite direction;

said first yarn guide means being disposed upstream of said first traction mechanism segment as seen in the given yarn travel direction, said second yarn guide means being disposed between said first and said second traction mechanism segments, and said at least one further yarn guide means being disposed downstream of said second traction mechanism segment;

said contour of said first yarn guide means having a greater curvature than said contour of said second yarn guide means, and said contour of said second yarn guide means having a greater curvature than said contour of said at least one further yarn means, the travelling yarn sliding along and looping part way around said contour of said first yarn guide means; and said contours being shaped and aligned relative to one another and to the yarn running line causing the yarn to travel from said contour of said first yarn guide means toward the yarn running line with loop-free contact with said contour of at least said second yarn guide means over a portion of the traverse winding width.

2. Traverse winding apparatus according to claim 1, wherein said portion of the traverse winding width is the middle portion of the traverse winding width.

3. Traverse winding apparatus according to claim 1, wherein one of the reversal points at each of said contours are disposed along one straight line and the other of the reversal points at each of said contours are disposed along another straight line.

4. Traverse winding apparatus according to claim 1, wherein said traction mechanism is an endless flat belt having a narrow edge on which said yarn entrainers are disposed; said first traction mechanism segment being disposed in the vicinity of and parallel to the yarn running line, said second traction mechanism segment being closely adjacent said first traction mechanism segment and said yarn guide means being formed of plate-like material.

5. Traverse winding apparatus according to claim 4, wherein both of said traction mechanism segments and said yarn guide means are verticle.

6. Traverse winding apparatus according to claim 4, wherein both of said traction mechanism segments and said yarn guide means are inclined by a maximum of approximately 15° toward a side of the machine at which the yarn enters.

7. Traverse winding apparatus according to claim 1, wherein said contours of said yarn guide means are continuously curved between the yarn reversal points.

8. Traverse winding apparatus for a machine producing cross-wound bobbins or cheeses including a drum winding a yarn travelling in a given yarn travel direction on a cheese over a given traverse winding width with reversal points, comprising a traction mechanism transmission having an endless traction mechanism, rollers over which said traction mechanism is guided defining first and second traction mechanism segments movable in opposite directions at the same speed; said traction mechanism including yarn entrainers spaced apart by at least substantially twice the given traverse winding width; and first, second and at least one further yarn guide means in alternation with said traction mechanism segments as seen in the given yarn travel direction for supporting the yarn during traverse winding and for transferring the yarn between said yarn entrainers at the reversal points; each of said yarn guide means having a concavely curved yarn guide contour with decreasing curvature compared to the previous guide means as seen in the given yarn travel direction to be contacted by the travelling yarn.

9. Traverse winding apparatus according to claim 6, wherein said contours of said yarn guide means are continuously curved between the yarn reversal points.

* * * * *